United States Patent [19]

DeVries et al.

[11] 4,311,341

[45] Jan. 19, 1982

[54] RESTORATION OF URANIUM SOLUTION MINING DEPOSITS

[75] Inventors: Frederick W. DeVries, Chadds Ford, Pa.; Bernard C. Lawes, Wilmington, Del.

[73] Assignee: E. I. Du Pont de Nemours & Company, Wilmington, Del.

[21] Appl. No.: 82,553

[22] Filed: Oct. 9, 1979

Related U.S. Application Data

[63] Continuation-in-part of Ser. No. 892,754, Apr. 3, 1978, abandoned.

[51] Int. Cl.[3] ..... E21B 43/28

[52] U.S. Cl. ..... 299/5

[58] Field of Search ..... 299/4, 5

[56] References Cited

U.S. PATENT DOCUMENTS

| | | | |
|---|---|---|---|
| 4,079,783 | 3/1978 | Snavely | 299/4 X |
| 4,114,693 | 9/1978 | Foster et al. | 299/4 |
| 4,134,618 | 1/1979 | Kossack | 299/4 |
| 4,162,707 | 4/1978 | Yan | 299/4 X |

*Primary Examiner*—William F. Pate, III

[57] ABSTRACT

A process is provided for restoring an ore deposit after uranium solution mining using ammonium carbonate leaching solutions has ceased. The process involves flushing the deposit with an aqueous solution of a potassium salt during which potassium ions exchange with ammonium ions remaining in the deposit. The ammonium-containing flushing solution is withdrawn from the deposit for disposal.

3 Claims, No Drawings

RESTORATION OF URANIUM SOLUTION MINING DEPOSITS

CROSS-REFERENCE TO RELATED APPLICATION

This application is a continuation-in-part of copending application Ser. No. 892,754 filed Apr. 3, 1978, now abandoned.

DESCRIPTION

1. Technical Field

This invention relates to processes for the solution mining of uranium ores and more particularly to site restoration after such processes have ceased.

2. Background Art

With the increasing use of nuclear power plants for the production of electricity in the United States, uranium ore deposits have become an increasingly valuable natural resource. Even though there are extensive uranium deposits distributed throughout the Western United States, many of these are located at too great a depth from the surface and/or are of too low concentration to be mined economically by conventional open pit or shaft mining techniques. Especially for such ore sources where conventional mining techniques are uneconomical or where they present severe ecological or esthetic problems, solution mining (in-situ leaching) has been proposed in many instances.

In a typical solution mining situation, a central production well can be drilled into a permeable uranium ore formation and a plurality of regularly spaced injection wells drilled around the production well. To start production, a leaching solution is pumped into the ore formation through the injection wells. The solution moves through the formation dissolving the uranium compounds in the ore as it passes toward the center of the ore formation from which it is removed by means of the production well. The leaching solution containing the dissolved uranium is then pumped to an extraction treatment zone where the leaching solution is treated to separate the uranium compounds. After the readily soluble uranium is removed, an oxidant is added to the leaching solution to solubilize the balance of the uranium.

A second solution mining method is the so-called push-pull technique. In this method, the leaching solution is injected into the ore deposit through a drilled well and then flow is reversed so that the leaching solution containing dissolved uranium is sucked out of the same well.

After being recharged with any components which may have become depleted, the leaching solution can then be recycled through the formation.

Several solution mining leaching solutions have been suggested. For example, the solvents most frequently used for leaching have been aqueous acid or carbonate solutions. The uranium can then be removed from the leaching solution by ways such as (1) adjusting the pH of the solution to neutral or basic pH to precipitate out the uranium, (2) separating the uranium compounds by ion exchange or (3) concentrating the uranium by liquid-liquid extraction. These processes are well known and are described in U.S. Pat. No. 2,896,930, issued July 28, 1959, to J. R. Menke and U.S. Pat. No. 3,860,289, issued Jan. 14, 1975, to R. P. Learmont.

Many in-situ leaching operations employ an alkaline carbonate leaching solution containing an oxidizing agent. The carbonate is present as an ammonium or sodium salt or mixtures thereof.

Ammonium ions are preferred in many cases because they are less likely to interfere with permeability of the ore formation. However, when ammonium carbonates are used in the leaching solution, ammonium ions deposit in the uranium ore formations and remain in the ground. This in turn causes a problem of ammonia contamination of ground water which may find its way into a drinking water supply. Typical water quality regulations place a very low limit on the amount of ammonia which may be present. Thus, after uranium solution mining has ceased, the mining site should be restored so as to be essentially ammonia-free.

At the present time, attempts to reduce the ammonia concentration in the mined ore deposits involve a water flush. This method is inefficient because vast amounts of water are needed and each gallon must be disposed. Thus, there is a need for a site restoration method which will reduce ammonia contamination of the ore deposits while reducing the amount of water which must be handled.

DISCLOSURE OF THE INVENTION

According to the present invention, there is provided in the solution mining of a uranium ore deposit using an aqueous leaching solution containing an ammonium carbonate, the improvement comprising: injecting into the ore deposit after mining has ceased an aqueous solution of a potassium salt.

The invention is concerned with ore deposit restoration after uranium solution mining using ammonium carbonate leaching solutions has ceased. Uranium solution mining is adequately described in the aforesaid U.S. Pat. Nos. 2,896,930 and 3,860,289, the descriptions of which are herein incorporated by reference. The term "carbonate", as used in describing the leaching solution, means both normal carbonate and bicarbonate (both simply referred to as $NH_3/CO_2$).

It has been discovered that the potassium ions injected into the ore deposit exchange with the ammonium ions left in the ore deposit during mining. The ammonium-containing aqueous solution is then withdrawn from the deposit for disposal.

The potassium salt used is preferably inorganic in order to avoid possible ore deposit contamination with organic impurities. Preferred potassium salts are the carbonate, bicarbonate, halide (preferably chloride), sulfate, bisulfate, persulfate and monopersulfate. Any particular salt or salt mixture used will depend on the composition of the ore deposit and the final leaching solutions left in the deposit. The pH of the solution is irrelevant.

Since the potassium salts will involve an added expense to the miner, the salt should be used in the least amount possible commensurate with the ability to displace ammonium ions while giving the least amount of waste water for disposal. Saving at least one flush will provide a financial savings because of the vast amount of water involved in just one flush. While an optimum aqueous flush solution concentration and sequence has not been established, the examples show that a potassium salt concentration of 5 g/l gives good removal of ammonium ions. Thus, the potassium salt concentration in the aqueous solution injected into the ore deposit should in most cases be less than about 10 g/l and preferably less than 5 g/l. However, it may be more beneficial in terms of efficiency to inject a concentrated potassium salt solution for the first flush and then follow it with several flushes of water.

BEST MODE—EXAMPLES

The invention can be further understood by the following examples in which parts and percentages are by weight unless otherwise indicated.

EXAMPLES 1-3

Three separate argillaceous uranium deposit core samples from South Texas were crushed so that the ore particles passed 6-mesh (U.S. Sieve) and then blended. The blended ore sample was analyzed and found to contain 6.7% water and 0.151% $U_3O_8$ by chemical analysis.

Fifteen hundred gram portions of the ore were tamped into 2-inch diameter (5 cm) Plexiglass® columns. Each ore column occupied 20.5 inches of column height (about 1055 cc). With a specific gravity of 2.6, the ore solids occupy 576 cc, leaving 479 cc as moisture and voids.

In-situ leaching of uranium was conducted by pumping a leach solution up through each ore sample by means of a constant speed, peristaltic pump so as to provide a leach solution flow rate of about 340 ml/day. The solution overflowed the top of the column via a glass tube inserted through a rubber stopper in the top of the column and then was collected for analysis.

Two aqueous ammonium carbonate leaching solutions were prepared having the following compositions:

| Ingredients | Composition (g/l) Solution 1 | Solution 2 |
|---|---|---|
| $NH_4$ carbonate | 8.6 | — |
| $NH_4$ hydroxide | 3.1 | 3.1 |
| Hydrogen peroxide (100% basis) | 1.0 | 1.0 |
| $NH_4$ bicarbonate | — | 8.6 |

After feeding 20 pore volumes of solution 1 through the ore sample in one column, 92.5% uranium removal was achieved. After uranium leaching, the ore sample residue was 1312 g which contained 0.08% $NH_3$. For solution 2, 92% of the uranium from the ore sample was recovered after 22 pore volumes of solution 2 was passed through the ore sample. In this latter leach test, the ore sample residue was 1382 g which contained 0.10% $NH_3$.

The residual ores from the above ammonium carbonate leach tests were treated for ammonia removal with water, and aqueous solutions of potassium sulfate, potassium peroxymonosulfate and potassium peroxymonosulfate plus potassium chloride. The procedure and solution flow rates were the same as in the in-situ leach tests. Data and results are shown in Tables I and II.

TABLE I

AMMONIA REMOVAL FROM RESIDUAL ORE

| Pore Volume | Control Water Σ Pore Volume | $NH_3$, g/l | % $NH_3$ Removed |
|---|---|---|---|
| 1.9 | 1.9 | 0.52 | 34.7 |
| 1.8 | 3.7 | 0.24 | 49.7 |
| 2.0 | 5.8 | 0.18 | 62.6 |
| Residue | — | 0.04% | — |
| Residue | | 553 g[1] | |
| Initial $NH_3$ concentration | | 0.10% | |
| Final $NH_3$ concentration | | 0.04% | |

TABLE I-continued

AMMONIA REMOVAL FROM RESIDUAL ORE

| Pore Volume | Example 1 5 g/l Potassium Sulfate Σ Pore Volume | $NH_3$, g/l | % $NH_3$ Removed |
|---|---|---|---|
| 3.2 | 3.2 | 0.97 | 87.2 |
| 2.3 | 5.4 | 0.05 | 90.3 |
| 2.4 | 7.8 | 0.03 | >93.0 |
| Residue | — | <0.01% | — |
| Residue | | 555 g[1] | |
| Initial $NH_3$ concentration | | 0.10% | |
| Final $NH_3$ concentration | | <0.01% | |

[1]Estimated pore volume of 205 ml.

TABLE II

AMMONIA REMOVAL FROM RESIDUAL ORE

| Pore Volume | Example 2 5 g/l Oxone® Σ Pore Volume | $NH_3$, g/l | % $NH_3$ Removed |
|---|---|---|---|
| 1.4 | 1.7 | 1.25 | 39.6 |
| 1.7 | 3.0 | 0.78 | 69.8 |
| 1.7 | 4.7 | 0.35 | 83.2 |
| 1.7 | 6.4 | 0.11 | 87.5 |
| Residue | — | 0.02% | — |
| Residue | | 631 g[1] | |
| Initial $NH_3$ concentration | | 0.08% | |
| Final $NH_3$ concentration | | 0.02% | |

| Pore Volume | Example 3 5 g/l Oxone® + 0.04 g/l KCl Σ Pore Volume | $NH_3$, g/l | % $NH_3$ Removed |
|---|---|---|---|
| 2.6 | 2.6 | 1.20 | 66.7 |
| 2.3 | 4.9 | 0.30 | 80.9 |
| 1.6 | 6.6 | 0.13 | 85.3 |
| 1.6 | 8.2 | 0.09 | 88.5 |
| Residue | — | 0.02% | — |
| Residue | | 583 g[2] | |
| Initial $NH_3$ concentration | | 0.08% | |
| Final $NH_3$ concentration | | 0.02% | |

[1]Estimated pore volume of 233 ml.
[2]Estimated pore volume of 215 ml.
Oxone® - Registered trademark for monopersulfate compound ($2KHSO_5 . KHSO_4 . K_2SO_4$).

The above results show the following ammonia removals: 63% with water; >93% with 5 g/l aqueous potassium sulfate; 88% with 5 g/l of Oxone® and 89% with 5 g/l of Ozone® and 0.04 g/l of potassium chloride.

We claim:

1. In the solution mining of a uranium ore deposit using an aqueous leaching solution containing an ammonium carbonate, the improvement comprising: injecting into the ore deposit after mining has ceased an aqueous solution of a potassium salt.

2. The process of claim 1 wherein the potassium salt is at least one selected from the group consisting of carbonate, bicarbonate, sulfate, halide, bisulfate, persulfate and monopersulfate.

3. The process of claim 2 wherein the aqueous solution is retained in the ore deposit for a time sufficient to exchange ammonium ions in the ore deposit for potassium ions in the aqueous solution and the ammonium-containing aqueous solution is withdrawn from the deposit.

* * * * *